US005680783A

United States Patent [19]

Kuroda

[11] Patent Number: 5,680,783

[45] Date of Patent: Oct. 28, 1997

[54] DOOR LOCK DEVICE WITH ANTI-THEFT MECHANISM

[75] Inventor: Katsuya Kuroda, Yamanashi-ken, Japan

[73] Assignee: Mitsui Kinzoku Kogyo Kabushiki Kaisha, Tokyo, Japan

[21] Appl. No.: 519,641

[22] Filed: Aug. 25, 1995

[30] Foreign Application Priority Data

| | | | |
|---|---|---|---|
| Aug. 31, 1994 | [JP] | Japan | 6-230735 |
| Aug. 31, 1994 | [JP] | Japan | 6-230736 |
| Sep. 1, 1994 | [JP] | Japan | 6-232015 |

[51] Int. Cl.[6] ..... E05C 3/06; E05C 13/00; E05B 47/00

[52] U.S. Cl. ..... 70/277; 292/336.3; 292/DIG. 65; 292/DIG. 23; 292/201; 70/280

[58] Field of Search ..... 70/280, 283, 264, 70/277, 278; 292/336.3, DIG. 27, DIG. 23, 201

[56] References Cited

U.S. PATENT DOCUMENTS

| | | | |
|---|---|---|---|
| 4,904,006 | 2/1990 | Hayakawa et al. | 292/DIG. 27 |
| 4,932,277 | 6/1990 | Beaux | 292/201 |
| 5,285,186 | 2/1994 | Chen | 307/10.2 |
| 5,351,042 | 9/1994 | Aston | 70/283 |
| 5,438,855 | 8/1995 | Ikeda | 292/DIG. 27 |
| 5,441,317 | 8/1995 | Grude et al. | 292/201 |
| 5,474,339 | 12/1995 | Johnson | 292/DIG. 27 |
| 5,503,441 | 4/1996 | Schwaiger | 292/DIG. 23 |
| 5,516,167 | 5/1996 | Hayakawa et al. | 292/201 |
| 5,531,488 | 7/1996 | Yoshikuwa et al. | 292/DIG. 23 |
| 5,534,846 | 7/1996 | Kuroda | 292/201 |
| 5,538,298 | 7/1996 | Ikeda | 292/DIG. 27 |

*Primary Examiner*—Darnell M. Boucher
*Attorney, Agent, or Firm*—Browdy and Neimark

[57] ABSTRACT

A door lock device having an anti-theft mechanism comprises a motor adapted to change a locking lever into a locking position by a normal rotation thereof in a predetermined amount, to change an anti-theft member into an anti-theft position by a continuous normal rotation thereof over the predetermined amount, and to return the anti-theft member to an anti-theft canceling position by a reverse rotation thereof. A controller has a locking operation of changing the locking lever into the locking position by using the motor, an anti-theft operation of changing the anti-theft member into the anti-theft position by using the motor, and an anti-theft canceling operation of changing the anti-theft member into the anti-theft canceling position by using the motor. If the anti-theft position of the anti-theft member is detected after performing the locking operation, the controller performs the anti-theft canceling operation.

9 Claims, 7 Drawing Sheets

DOOR LOCK DEVICE WITH ANTI-THEFT MECHANISM

BACKGROUND OF THE INVENTION

1. Field of the Invention

The present invention relates to a door lock device provided with an anti-theft mechanism for enhancing crime prevention capability thereof.

2. Description of the Related Art

It is conventional to place a door lock device into a locked state by displacing a locking lever to a locking position from a unlocking position by manipulation of a door key cylinder or an inside lock button. Further, it has also been well known that the locked state of the lock device can illegally be canceled without a door key, by inserting a gripping tool into a vehicle through a gap between a door and a vehicle body so as to change the position of an inside lock button into an unlocking position.

Previously, there have been proposed several kinds of anti-theft mechanisms to preclude such an illegal operation. Each of these mechanisms has an anti-theft member, which is changed between an anti-theft position for disconnecting an inside lock button from a locking lever and an anti-theft canceling position for connecting the lock button with the locking lever. When the anti-theft member is in an anti-theft position, the locking lever can not be changed into the locking position by manipulation of the inside lock button.

FIG. 12 is a schematic diagram illustrating operations of changing the positions of a locking lever A and an anti-theft member B. The locking lever A is held in one of a locking position and an unlocking position by the elasticity of a spring C. The anti-theft member B is held in one of an anti-theft position and an anti-theft canceling position by the elasticity of a spring D. If an output member E is turned to a locking point Y by a motor M against the elasticity of a spring F, the locking lever A is changed into the locking position. If the output member E is turned to an anti-theft point Z over the locking point Y, the anti-theft member B is changed into the anti-theft position. Further, if the output member E is reversed to an unlocking point X, the locking lever A returns to the unlocking position and the anti-theft member B also returns to the anti-theft canceling position.

In the case of the mechanism of FIG. 12, the output member E turned by the motor M rotates a little excessively after the energizing of the motor M is stopped. Then, the output member E returns to an initial position thereof by the elasticity of a spring F. An amount of the excessive rotation of the member E changes largely with variation in resistance to rotation or movement of components of the lock device or in voltage of a battery serving as a power source for the motor. For example, when the voltage of the battery is high, the rotating torque of the motor M becomes high and the rotating speed thereof also becomes high. Thus the amount of the excessive rotation of the output member E becomes large.

The excessive rotation sometimes results in degradation in quality of the lock device. If largely excessive rotation occurs when the output member E is caused to turn to the locking point Y, the output member E sometimes changes the anti-theft member B to the anti-theft position by moving to point Z. Lowering of the voltage to be supplied to the motor is, however, unfavorable for preventing a malfunction. Namely, when the basic voltage of the battery drops, the voltage to be supplied to the motor becomes lower than a necessary voltage. Consequently, there is a fear that the rotating torque of the motor M is weaker than the elasticity of the spring D and thus the anti-theft member B can not be changed into the anti-theft position.

SUMMARY OF THE INVENTION

Accordingly, an object of the present invention is to provide a lock device which can automatically cancel the anti-theft state thereof when being erroneously changed into the anti-theft state.

Further, another object of the present invention is to provide a power supply circuit which can restrain the state of a lock device from being erroneously changed into the anti-theft state.

Other features, objects and advantages of the present invention will become apparent from the following description of a preferred embodiment with reference to the drawings in which like reference characters designate like or corresponding parts throughout several views.

DETAILED DESCRIPTION OF THE PREFERRED EMBODIMENT

Figure 1:
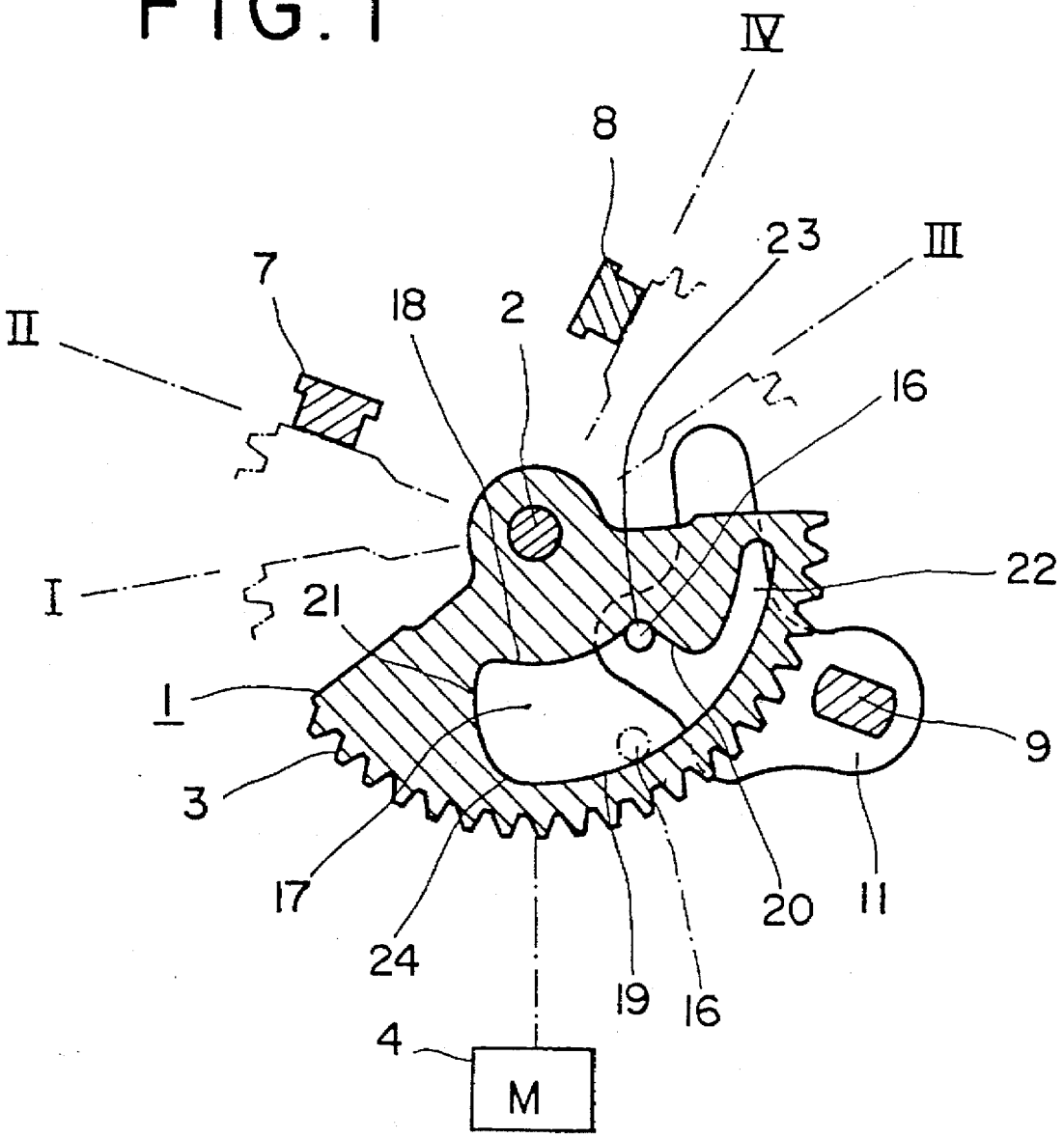
FIG. 1 is a schematic diagram for illustrating the configuration of an actuator unit having an anti-theft mechanism according to the present invention.

Hereinafter, a preferred embodiment of the present invention will be described in detail by referring to the accompanying drawings. FIG. 1 is a diagram for schematically illustrating the configuration of an actuator unit having an anti-theft mechanism for a vehicle door lock device. The unit has a fan-shaped output member 1 which is rotatably supported on a shaft 2. The output member 1 has a gear portion 3 on a periphery thereof, which meshes with an output gear (not shown) of a motor 4. As illustrated in FIG.

2, a spring 6 for returning the output member 1 to a neutral position is enclosed in a circular groove 5 which is bored in the top surface portion of the output member 1 around the shaft 2.

The output member 1 indicated by solid lines and curves in FIG. 1 is in the neutral position. When the motor 4 is not energized, the output member 1 is held in the neutral position by the elasticity of the returning spring 6. When the motor 4 rotates in the normal direction, the output member 1 can be clockwise turned from the neutral position through a locking point I to an anti-theft point II (hereunder often referred to as an AT point) where the member 1 is put into abutting engagement with a rubber stopper 7. Conversely, when the motor 4 is reversed, the output member 1 can be counterclockwise turned from the neutral position through an anti-theft canceling point III (hereunder often referred to as an AT canceling point) to an unlocking point IV where the member 1 is put into abutting engagement with a rubber stopper 8.

Figure 2:
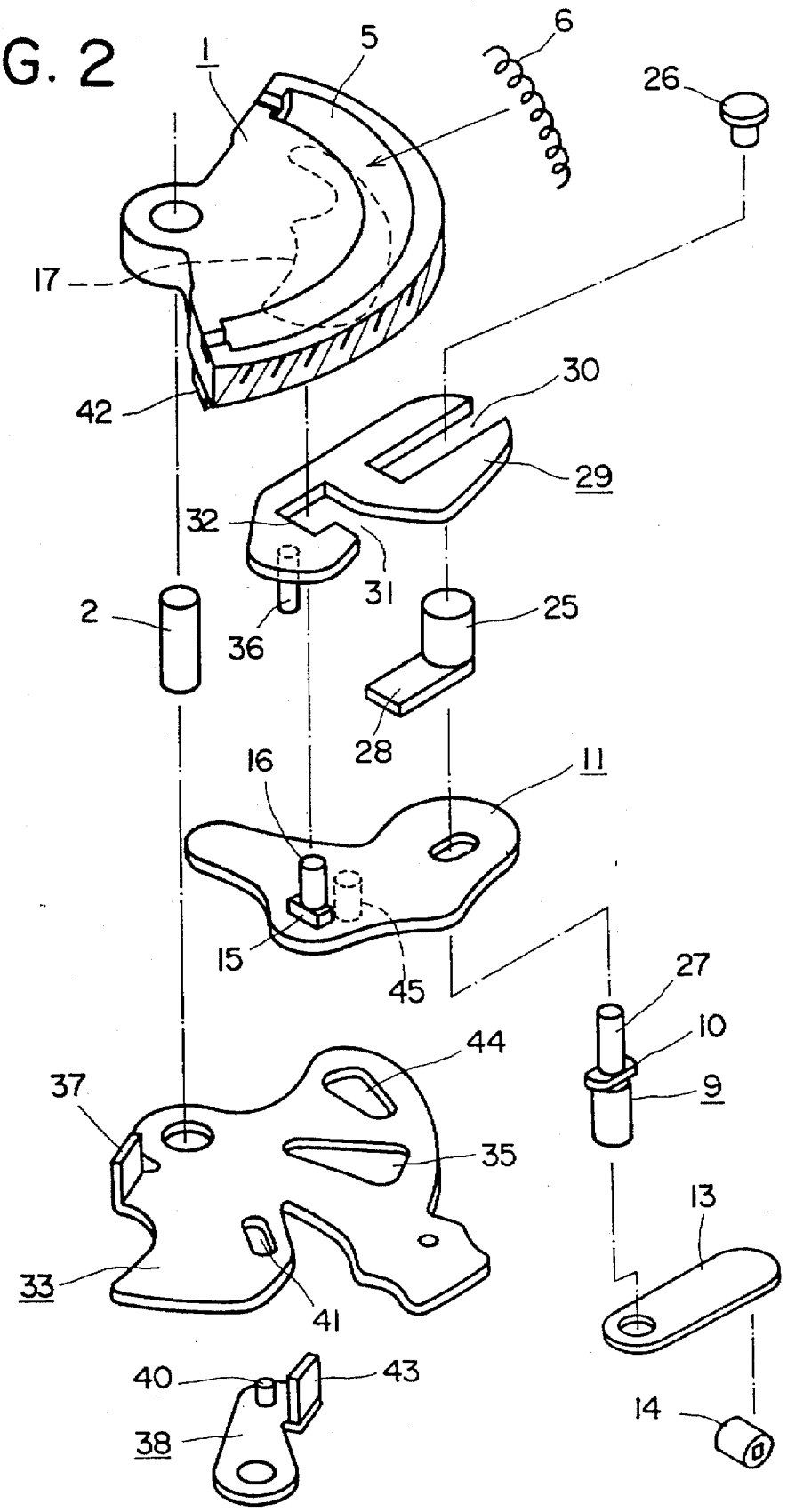
FIG. 2 is an exploded perspective view of the actuator unit.

As illustrated in FIGS. 1 and 2, the actuator unit further has an interlocking lever or inner locking lever 11 fixed to a hexagonal portion 10 on a shaft 9. A lower end of the shaft 9 is connected to a well known locking lever 13 of the lock device which is displaced between a locking position and an unlocking position. Thus, the locking lever 13 and the interlocking lever 11 are integrally connected with each other. The locking lever 13 is omitted in FIGS. 3 to 8. because the locking lever 13 is substantially integral with the interlocking lever 11 in this way. Further, hereinafter, the lever 11 will be expressed as an inner locking lever or a locking lever. Reference numeral 14 designates a door key cylinder connected to the locking lever 13.

A box-like convex portion 15 is provided on the surface of the inner locking lever 11. Further, an upwardly protruding stick-like projection 16 is provided on the top of the convex portion 15. The projection 16 is faced to a cam recess 17 formed in the bottom surface portion of the output member 1. If the output member 1 is turned from the neutral position clockwise or counterclockwise around the shaft 2, a peripheral wall of the cam recess 17 comes into contact with the projection 16 and causes the inner locking lever 11 to rotate.

Figure 3:
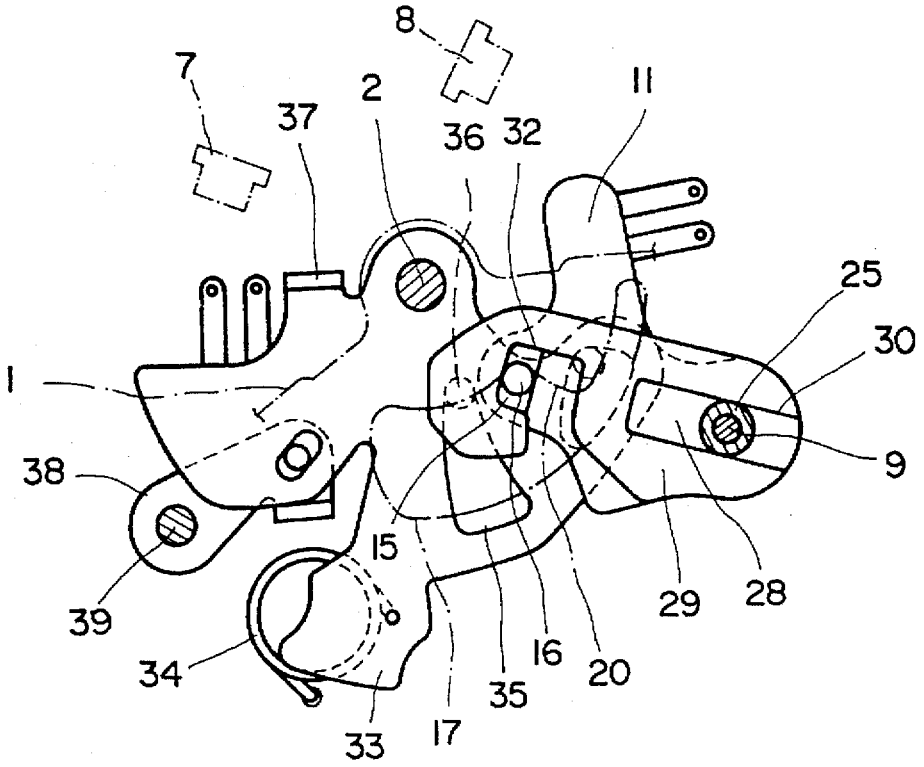
FIG. 3 is a diagram for illustrating the unlocked state of the actuator unit when the motor is turned off.
Figure 4:
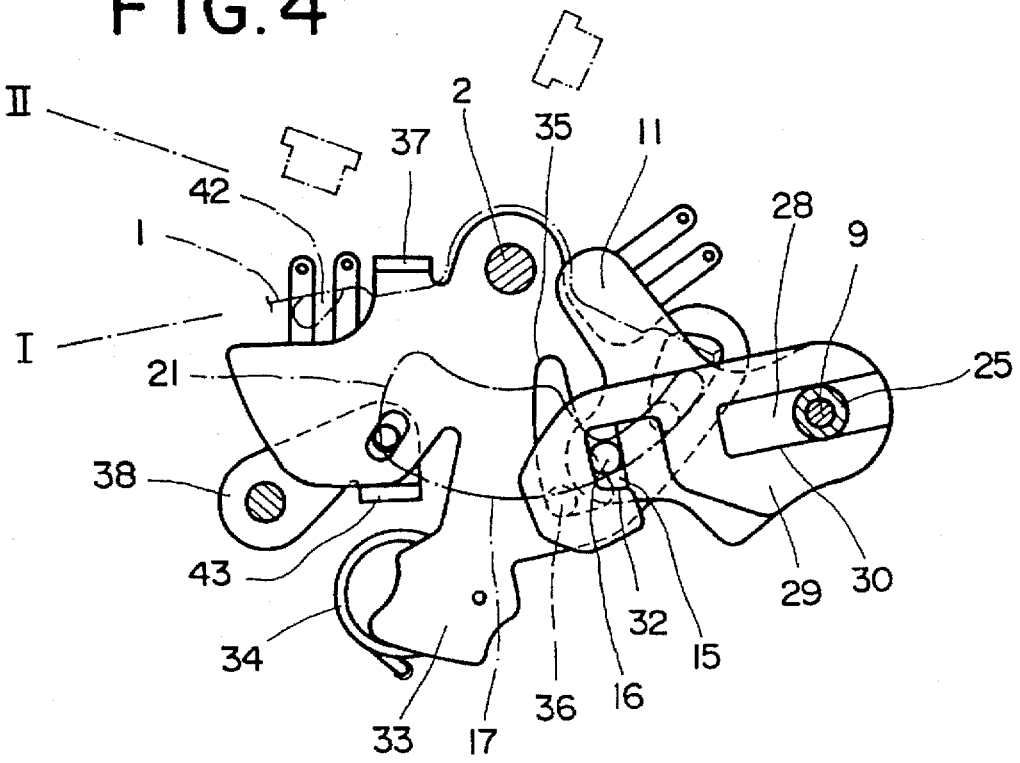
FIG. 4 is a diagram for illustrating a state of the actuator unit in which an output member of FIG. 3 is turned to a locking point I.

The relation between the output member 1 and the inner locking lever 11 will be described further detailedly hereinbelow with reference to FIG. 1. The cam recess 17 formed in the output member 1 is composed substantially of an inner cam wall 18, an outer cam wall 19, a right-side cam wall 20 and a left-side cam wall 21. The inner and outer cam walls 18, 19 are formed like a circular arc centered at the shaft 2. An escape slot 22 extending along a circular arc centered at the shaft 2 is bored in the intersection portion between the outer cam wall 19 and the right-side wall 20. The projection 16 of the inner locking lever 11 in the unlocking position is indicated by a solid circle in FIG. 1 and is placed at a first corner 23 between the inner cam wall 18 and the right-side wall 20. When the output member 1 is turned clockwise by the motor 4 to the looking point I, the projection 16 placed at the first corner 23 (see FIG. 3) is pushed by the right-side cam wall 20 and is thus displaced I to the locking position indicated by dotted lines and curves in FIG. 1. FIG. 4 illustrates a state of the unit in which the output member 1 is turned to the locking point I.

Figure 7:
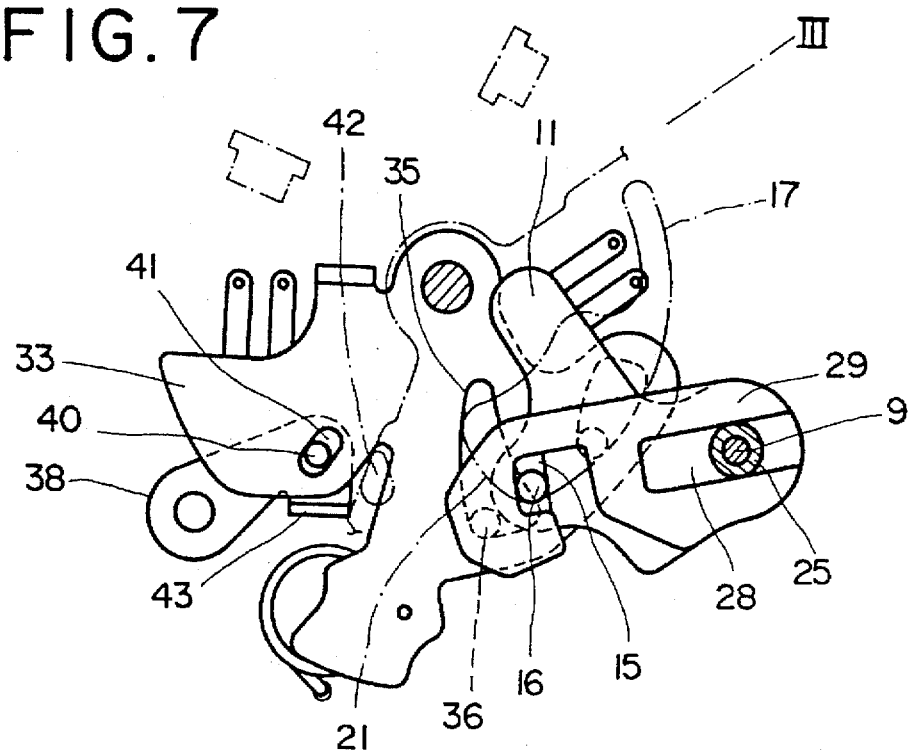
FIG. 7 is a diagram for illustrating a state of the actuator unit in which the output member of FIG. 6 is turned to an anti-theft canceling point III.
Figure 8:
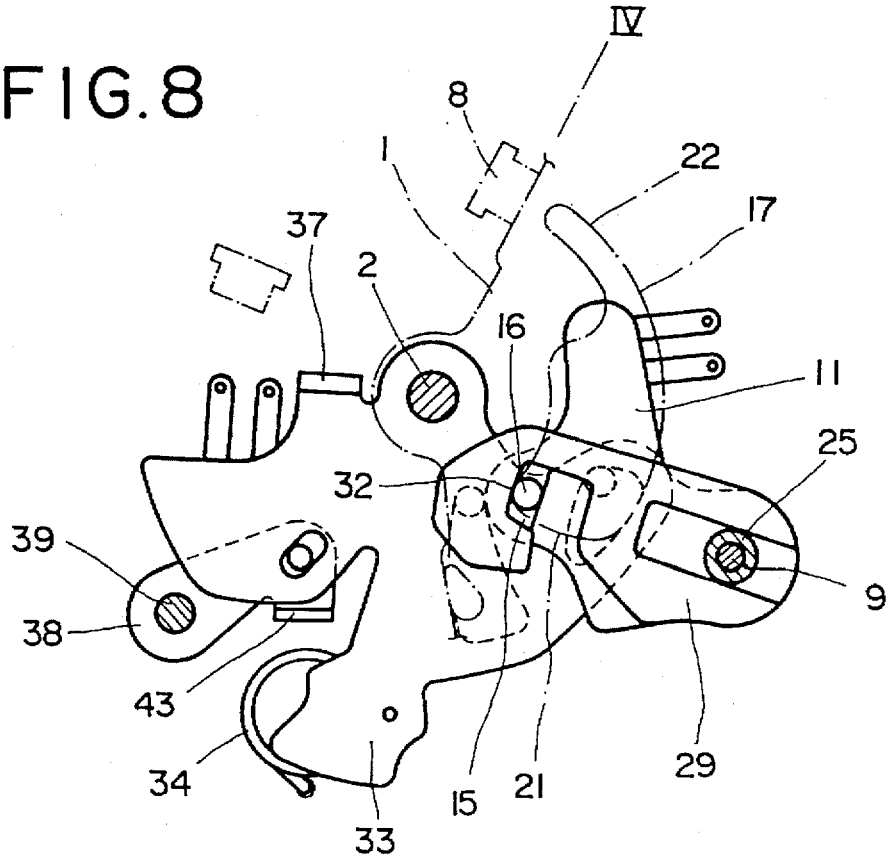
FIG. 8 is a diagram for illustrating a state of the actuator unit in which the output member of FIG. 7 is turned to an unlocking point IV.

As illustrated in FIG. 1, the projection 16 is spaced apart from a second corner 24, which is between the outer cam wall 19 and the left-side cam wall 21, when the output member 1 is in the neutral position. The distance between the corner 24 and the projection 16 is set as being equal to the distance the output member 1 moves between the neutral position and the AT canceling point III. In other words, when the output member 1 is turned from the neutral position to the AT canceling point, the second corner 24 is first brought into abutting engagement with the projection 16 when in the locking position. Therefore, as illustrated in FIG. 7, even when the output member 1 is turned counterclockwise from the neutral position to the AT canceling position III, the inner locking lever 11 remains in the locking position because projection 16 is not moved in cam recess 17 by output member 1. When the output member 1 is turned to the unlocking point IV from the AT canceling point III as illustrated in FIG. 8, the left-side wall 21 pushes the projection 16 to thereby displace the inner locking lever 11 into the unlocking position. Incidentally, the reason for the positioning of the second corner 24 in the neutral position and the positioning of projection 16 in the locking position so that corner 24 and projection 16 are spaced apart is to enable the canceling only of the anti-theft state and not the locking position. Further, when the output member 1 is turned clockwise to the AT point II from the locking point I, the projection 16 having been in the locking position enters the escape groove 22 as shown in FIG. 5.

The actuator unit has a hollow shaft 25 to be connected to a well known inside lock button 26 of the lock device mounted on the inner surface of a door. An upper portion of the shaft 9 is rotatably inserted into the hollow shaft 25. A key portion 28, which projects radially, is integral with and is attached to the hollow shaft 25. A bifurcate portion 30 formed in an anti-theft member 29 (hereunder often referred to as an AT member) is slidably engaged with the key portion 28. The inside lock button 26 and the AT member 29 are always connected with each other as the result of the engagement between the key portion 28 and the bifurcate portion 30. The AT member 29 has a hook 32 with which the convex portion 15 of the inner locking lever 11 is engageable.

Figure 5:
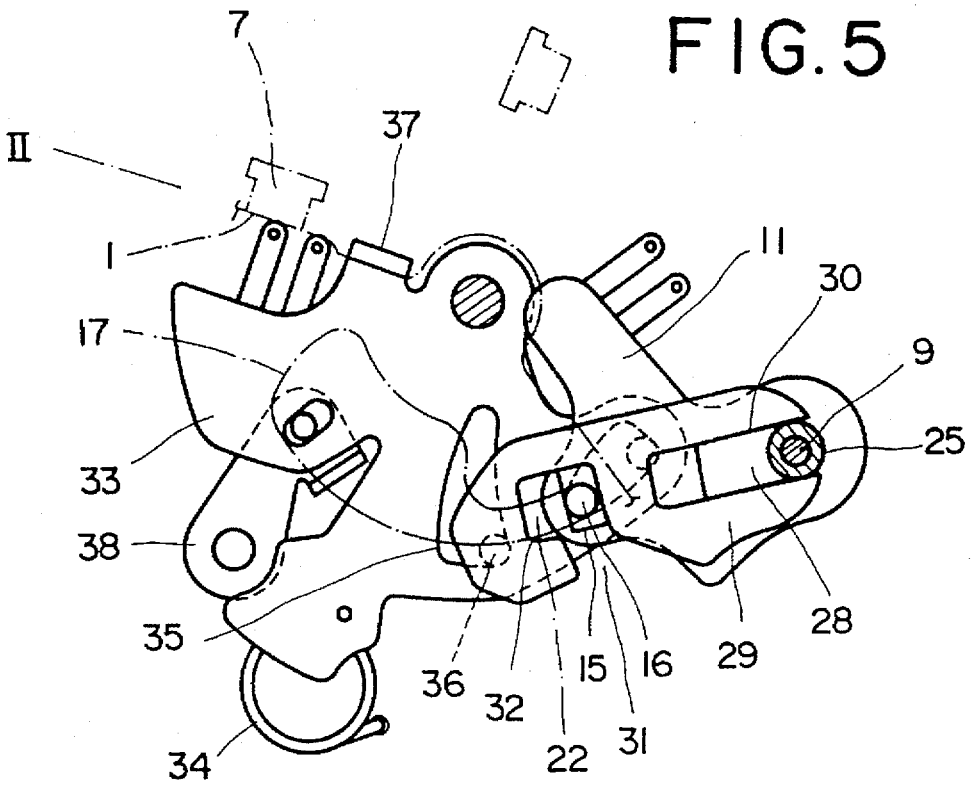
FIG. 5 is a diagram for illustrating a state of the actuator unit in which the output member of FIG. 4 is turned to an anti-theft point II.

When the AT member 29 is slid to the left from the position thereof illustrated in FIG. 4 (incidentally, the practical method of sliding the AT member 29 will be described later), the convex portion 15 is disengaged with the hook 32 as illustrated in FIG. 5 so as to face an opening portion 31 of the hook. When the convex portion 15 engages with the hook 32 as illustrated in FIG. 4, the inside lock button 26 and the inner locking lever 11 are connected with each other. Thus the state of the lock device can be freely changed between a locked state and an unlocked state by manipulating the inside lock button 26. However, when the convex portion 15 faces the opening portion 31 as shown in FIG. 5, the hook 32 can not engage with the convex portion 15 even if the AT member 29 is turned clockwise by unlocking the inside lock button 26. Therefore, the inner locking lever 11 can not be displaced to the unlocking position. This swinging-and-missing mechanism is an anti-theft mechanism of the present invention. The position of the AT member 29 of FIG. 5 is an anti-theft position (hereunder sometimes referred to as an AT position). Further, the position of the AT member 29 of FIG. 4 is an anti-theft canceling position (hereunder sometimes referred to as an AT canceling position).

A switching member 33 is provided under the inner locking lever 11 in such a manner as to be rotatably supported on the shaft 2. The switching member 33 is operative to slide the AT member 29 and is preferably made of a thin metallic plate. An over-center spring 34 (see FIG. 3) has an end caught by the switching member 33 and the other end caught on a case (not shown) of the actuator unit. The switching member 33 is held in one of a non-operating position of FIG. 3 and an operating position of FIG. 5, the border between which is defined by the dead point of the over-center spring 34, respectively.

A nearly triangular hole 35 is bored in the switching member 33. A pin 36 formed on the AT member 29 is engaged with the hole 35. When the switching member 33 is in the non-operating position, the AT member 29 is held in the AT canceling position as the result of the engagement between the hole 35 and the pin 36, as illustrated in FIGS. 3 and 4. When the switching member 33 is displaced to the operating position over the dead point of the over-center spring 34, the AT member 29 is slid to the left and is displaced to the anti-theft position as the result of the engagement between the hole 35 and the pin 36, as viewed in FIGS. 5 and 6.

A bending piece 37 which is engageable with a side face of the output member 1 is provided on the switching member 33. The side edge of the output member 1 is not brought into abutting engagement with the bending piece 37 when the output member 1 is turned to the locking point I as illustrated in FIG. 4. The side edge of the output member 1, however, pushes the bending piece 37 and changes the position of the switching member 33 from the non-operating position to the operating position against the elasticity of the over-center spring 34 as illustrated in FIG. 5 when the output member 1 is turned to the AT point II from the locking point I. Thereby, the AT member 29 is displaced to the AT position as pin 36 moves in hole 35.

To summarize the foregoing description of this embodiment briefly, in the case of the unit of the present invention, the inner locking lever 11 (locking lever 13) is displaced to the locking position by the engagement between the right-side cam wall 20 and the projection 16 when the output member 1 is turned to the locking point I as shown in FIG. 4. Further, as shown in FIG. 5 when the output member 1 is turned to the anti-theft point II from the locking point I, the anti-theft member 29 comes to be displaced to the anti-theft position, but the inner locking lever 11 remains in the locking position.

Figure 6:
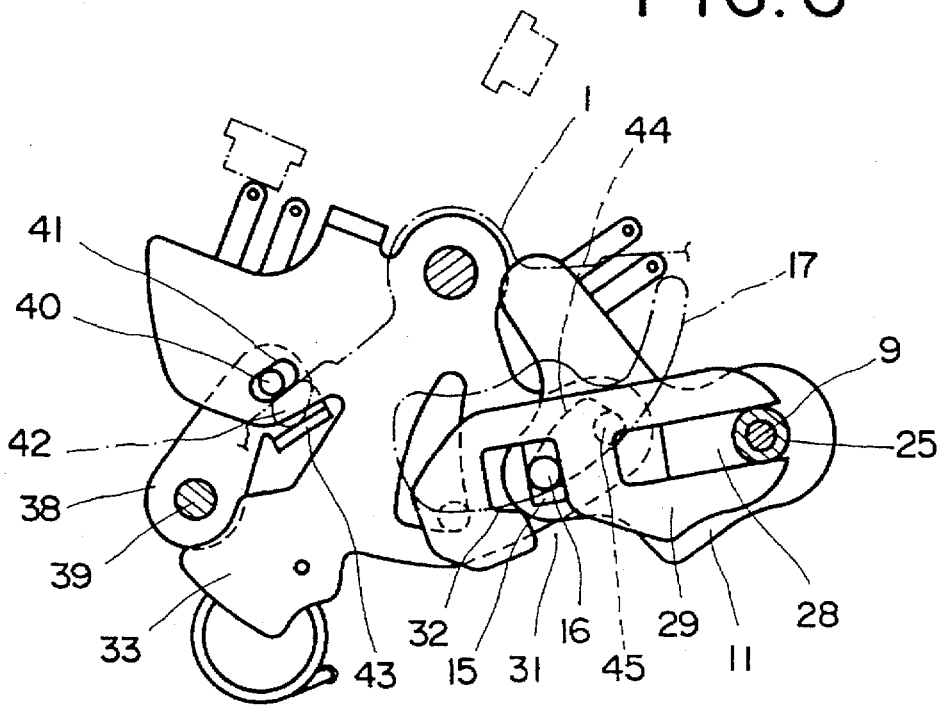
FIG. 6 is a diagram for illustrating the anti-theft state of the actuator unit in which the output member of FIG. 5 returns to a neutral position.

The actuator unit has an anti-theft canceling lever 38 for returning the switching member 33 from the operating position to the non-operating position by utilizing the power of the motor 4. The lever 38 is rotatably supported on a shaft 39. The lever 38 has a projection 40 to be engaged with an elongated hole 41 formed in the switching member 33. The lever 38 further has an engagement piece 43 which can engage with a drop-like convex portion 42 provided on the bottom surface of the output member 1. When the switching member 33 is in the operating position and the output member 1 is in the neutral position as illustrated in FIG. 6, the engagement piece 43 and the convex portion 42 are faced to each other. If the output member 1 is counterclockwise turned to the AT canceling point III when being in the state of FIG. 6, the convex portion 42 of the output member 1 pushes the engagement piece 43 and thus causes the canceling lever 38 to turn clockwise. Then, the engagement between the elongated hole 41 and the projection 40 causes the switching member 33 to turn counterclockwise and to move from the operating position to the non-operating position. Further, the position of the AT member 29 is changed from the AT position to the AT canceling position. Thereby, the anti-theft state is canceled. The left-side cam wall 21 of the cam recess 17 is, however, not engaged with the projection 16 of the inner locking lever 11 as described above even when the output member 1 is turned to the AT canceling point III counterclockwise, and the inner locking lever 11 remains in the locking position. This is an operation of canceling only the anti-theft state. Further, in the case where the position of the inner locking lever 11 is changed to the unlocking position, it is required to turn the output member 1 counterclockwise to the unlocking point IV from the AT canceling point III.

The switching member 33 has another hole 44 which is shaped nearly like a triangular. A pin 45 formed on the inner locking lever 11 is engaged with the hole 44. If the inner locking lever 11 is changed as the result of an unlocking operation performed on the door key cylinder 14 into the unlocking position when the inner locking lever 11 is in the locking position and the AT member 29 is in the anti-theft position as illustrated in FIG. 6, the switching member 33 is changed from the operating position to the non-operating position owing to the engagement between the hole 44 and the pin 45. Consequently, the AT member 29 is returned to the AT canceling position.

Figure 9:
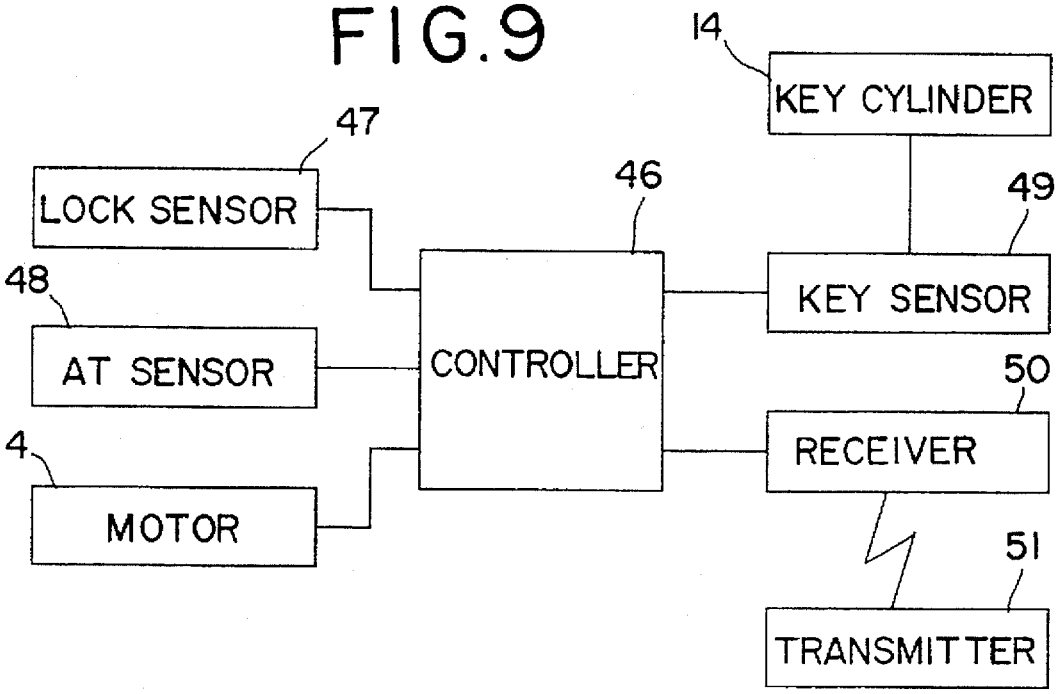
FIG. 9 is a block diagram for illustrating the configuration of a circuit for performing a control operation according to the present invention.

FIG. 9 illustrates the configuration of a block circuit for performing a control operation according to the present invention. The block circuit has a controller 46, a lock sensor 47 for detecting the position of the inner locking lever 11, an anti-theft sensor 48 for detecting the position of the switching member 33 (the anti-theft member 29), a key sensor 49 for detecting the position of the door key cylinder 14, and a receiver 50 for receiving an operation signal from a remote control transmitter 51. The controller 46 is adapted to control (1) a locking operation of changing the inner locking lever 11 to the locking position by using the motor 4 for a predetermined amount of normal rotation, (2) an anti-theft operation of changing the anti-theft member 29 to the anti-theft position by using the motor 4 for a continuous normal rotation of the motor over the predetermined amount for the locking operation, (3) an anti-theft canceling operation of changing the anti-theft member 29 to the anti-theft canceling position by using the motor 4 and holding the inner locking lever 11 in the locking position, and (4) an unlocking operation of changing the inner locking lever 11 to the unlocking position by using the motor 4.

If the key sensor 49 detects the locking position of the key cylinder 14, or the receiver 50 detects a lock signal sent from the transmitter 51 during being in the unlocked state, the controller 46 starts performing the locking operation. In the case of the locking operation, the controller 46 causes the output member 1 to turn to the locking point I by utilizing the power of the motor 4. Thereby, the inner locking lever 11 is changed into the locking position (see FIG. 4). When the lock sensor 47 detects the locking position of the inner locking lever 11, the controller 46 stops energizing the motor 4.

If an anti-theft signal is given to the controller 46 by utilizing the key cylinder 14 or the transmitter 51, the controller 46 starts performing the anti-theft operation. In the case of the anti-theft operation, the controller 46 causes the motor 4 to turn the output member 1 to the anti-theft point II. Thereby, the inner locking lever 11 is changed into the locking position. Moreover, the anti-theft member 29 is changed into the anti-theft position (see FIG. 5). When the anti-theft sensor 48 detects the anti-theft position of the AT member 29, the controller 46 stops energizing the motor 4.

If an anti-theft canceling signal is given to the controller 46 by utilizing the key cylinder 14 or the transmitter 51, the controller 46 starts performing the anti-theft canceling operation. In the case of the anti-theft canceling operation, the controller 46 causes the motor 4 to turn the output member 1 to the anti-theft canceling point III. Thereby, the anti-theft member 29 is changed into the AT canceling position (see FIG. 7). When the anti-theft sensor 48 detects the anti-theft canceling position of the AT member 29, the controller 46 stops energizing the motor 4.

If an unlock signal is given to the controller 46 by utilizing the key cylinder 14 or the transmitter 51, the controller 46 starts performing the unlocking operation. In the case of the unlocking operation, the controller 46 causes the motor 4 to turn the output member 1 to the unlocking point IV. Thereby, the AT member 29 is changed into the AT canceling position. Moreover, the inner locking lever 11 is changed into the unlocking position (see FIG. 8). When the lock sensor 47 detects the unlocking position of the inner locking lever 11, the controller 46 stops energizing the motor 4.

In the case of the locking operation, the output member 1 can be turned excessively to some extent owing to the inertia thereof even after the controller 46 stops energizing the motor 4. If the amount of this excessive rotation is large, the output member 1 can malfunction and change the position of the switching body 33 from the non-operating position to the operating position. Thus, the AT member 29 is unintentionally changed into the AT position. If such a malfunction occurs by any chance, the controller 46 senses the unintentional change to the AT position returns the anti-theft member 29 to the anti-theft canceling position by utilizing the power of the motor 4. Namely, in the case of the locking operation, after the energizing of the motor 4 is stopped, the controller 46 monitors the position of the AT member 29 by using the anti-theft sensor 48. If it is detected by any chance that the anti-theft member is in the anti-theft position, the anti-theft canceling operation is performed.

As previously described, in the case of the locking operation, as one of the causes of the erroneous change in position of the AT member 29 to the anti-theft position, it can be cited that the rotational speed of the motor 4 becomes high owing to the high voltage of a battery and thus the amount of the rotation of the output member 1 is increased. Therefore, the unit of the present invention is provided with an improved power supply circuit for regulating the voltage of the battery.

Figure 10:
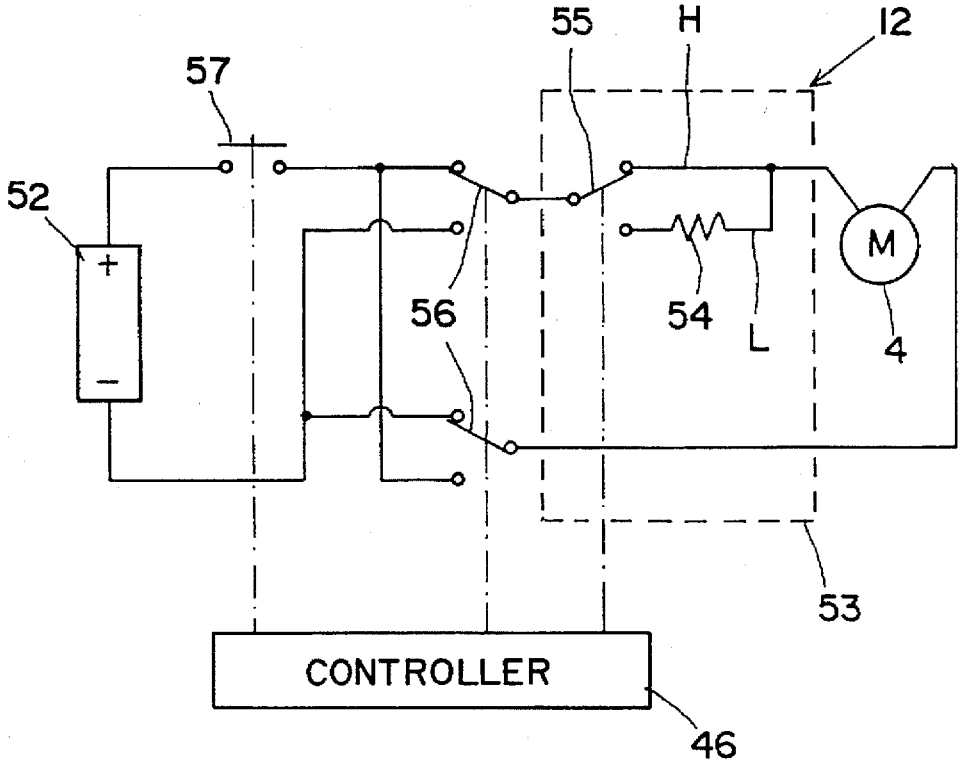
FIG. 10 is a diagram for illustrating the configuration of a power supply circuit of the present invention.

FIG. 10 illustrates the configuration of a power supply circuit 12 for supplying the power from a battery 52 to the motor 4. The power supply circuit 12 has a main switch 57, switches 56 and 56 for changing the direction of rotation of the motor 4, and a voltage changing circuit 53. Further, the voltage changing circuit 53 has a high-voltage line H for connecting the battery 52 directly to the motor 4, a low-voltage line L for connecting the battery 52 to the motor 4 through a resistor 54, and a switch 55 for selectively connecting one of the high-voltage line H or the low-voltage line L to the motor 4. When the amount of the excessive rotation of the output member 1 should be decreased as in the case of the locking operation, the battery 52 is connected with the motor 4 through the low-voltage line L and thus the voltage supplied from the battery 52 is lowered.

Figure 11:
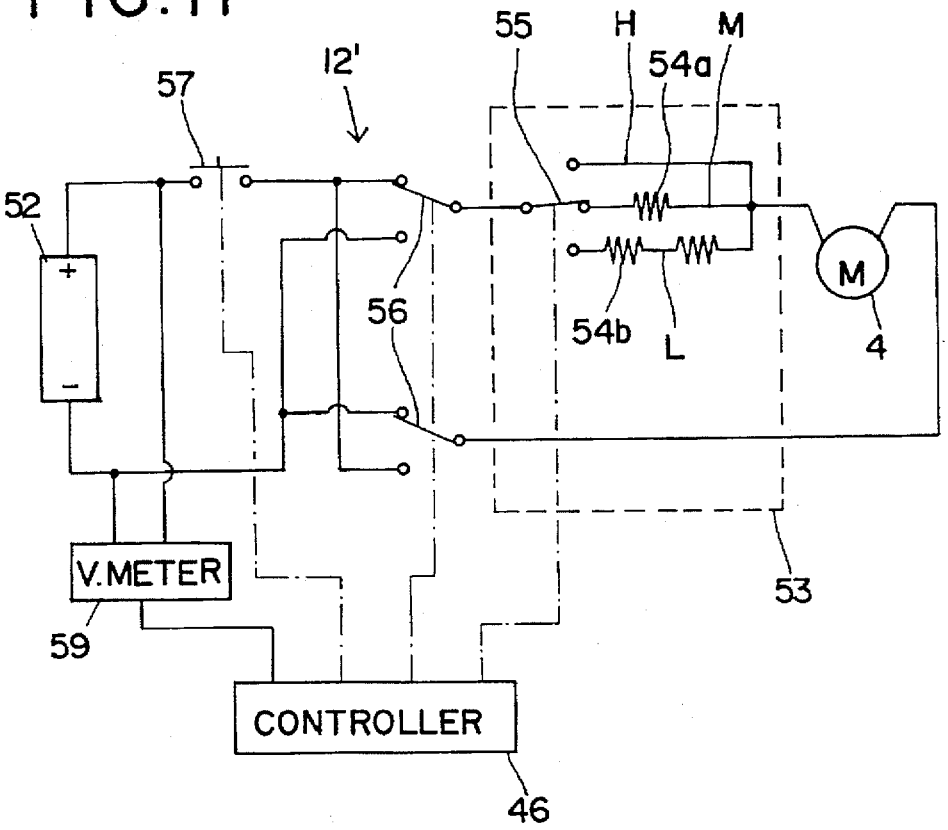
FIG. 11 is a diagram for illustrating the configuration of another power supply circuit of the present invention.
Figure 12:
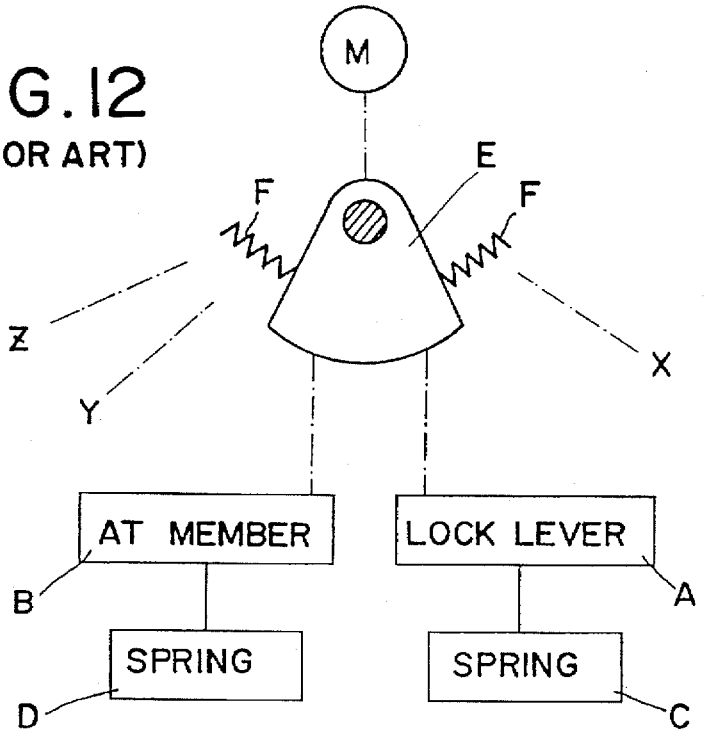
FIG. 12 (PRIOR ART)
FIG. 12 is a diagram for illustrating the configuration of the conventional anti-theft mechanism.

FIG. 11 illustrates the configuration of another power supply circuit 12'. A voltage changing circuit 53 of the power supply circuit 12' has a high-voltage line H for connecting the battery 52 directly to the motor 4, a medium voltage line M for connecting the battery 52 to the motor 4 through a resistor 54*a* having a low resistance, and a low-voltage line L for connecting the battery 52 to the motor 4 through another resistors 54*b* having a high resistance. In the case where the power supply circuit 12' is employed in the door lock device, the controller 46 connects the battery 52 with the motor 4 basically through the medium-voltage line M in all of the operations.

Here again, if the voltage supplied from the battery 52 is too high, the amount of the excessive rotation of the motor 4 (thus the output member 1) becomes large. In contrast, if the voltage supplied from the battery 52 is too low, the rotating torque of the motor 4 becomes weaker than the elasticity of the over-center spring 34 and thus the state of the anti-theft member can not be changed into the anti-theft state. Thus, information representing the range of appropriate voltages between the lowest voltage required for producing the rotating torque in the motor 4, which is sufficient to overcome the elasticity of the over-center spring 34, and the highest voltage required for preventing an occurrence of the excessive rotation, which may change the state of the lock device into the anti-theft state, is stored in the controller 46. If the voltage supplied from the battery 52, which is measured by a voltage meter 59, is out of the range of the appropriate voltages, the voltage to be supplied to the motor 4 is regulated by operating the switch 55 of the power supply circuit 12'. If a switching failure occurs when the motor 4 is rotated at the voltage regulated in this manner, the information representing the range of the appropriate voltages, which is stored in the controller 46, is corrected.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A door lock device having an anti-theft mechanism, comprising:

a locking lever connected to an inside lock button of a door and being displaceable between a locking position and an unlocking position;

an anti-theft member being displaceable between an anti-theft position for disabling an unlocking operation of the inside lock button and an anti-theft canceling position for enabling the unlocking operation of the inside lock button;

motor means for moving the locking lever into the locking position by a normal rotation thereof in a predetermined amount, moving the anti-theft member into the anti-theft position by a continuous normal rotation thereof over the predetermined amount for moving the locking lever into the locking position, and returning the anti-theft member to the anti-theft canceling position by a reverse rotation thereof;

controller means having a locking operation for changing the locking lever into the locking position by using the motor, an anti-theft operation for changing the anti-theft member into the anti-theft position by using the motor, and an anti-theft canceling operation for changing the anti-theft member into the anti-theft canceling position by using the motor whether or not the anti-theft operation had been actuated; and sensor means for detecting a position of the anti-theft member;

wherein if the sensor means detects an unintentional displacement to the anti-theft position of the anti-theft member after performing only the locking operation, the controller means automatically actuates the anti-theft canceling operation.

2. The door lock device according to claim 1, further comprising a voltage changing circuit for supplying power having different voltages to the motor means under control of the controller means, wherein the controller means sets a voltage to be supplied to the motor means when performing the locking operation as being lower than a voltage to be supplied to the motor means when performing the anti-theft operation.

3. The door lock device according to claim 2, wherein the voltage changing circuit has a high-voltage line having a low line resistance, a low-voltage line having a high line resistance, and a switch for selectively connecting one of the lines with the motor means.

4. The door lock device according to claim 1, further comprising a voltage changing circuit for supplying power having different voltages to the motor means under control of the controller means, wherein the controller means has information representing an appropriate voltage range of voltages suitable for performing the operations, wherein if a voltage supplied from a battery of a vehicle is out of the appropriate voltage range, the voltage supplied to the motor means is regulated by the voltage changing circuit.

5. The door lock device according to claim 4, wherein the highest voltage of the appropriate voltage range is a voltage at which the anti-theft member is not changed by the motor into the anti-theft position when performing the locking operation, wherein the lowest voltage of the appropriate voltage range is a voltage at which the anti-theft member is surely changed by the motor means into the anti-theft position when performing the anti-theft operation.

6. The door lock device according to claim 4, wherein the information representing the appropriate voltage range stored in the controller means is alterable.

7. The door lock device according to claim 1, wherein the anti-theft canceling operation is to displace only the anti-theft member to the anti-theft canceling position by holding the locking lever in the locking position.

8. A door locking device having an anti-theft mechanism, comprising:

a locking lever connected to an inside lock button of a door and being displaceable between a locking position and an unlocking position;

an anti-theft member being displaceable between an anti-theft position for disabling an unlocking operation of the inside lock button and an anti-theft canceling position for enabling the unlocking operation of the inside lock button;

motor means for moving the locking lever into the locking position by a normal rotation thereof in a predetermined amount, moving the anti-theft member into the anti-theft position by a continuous normal rotation thereof over the predetermined amount for moving the locking lever into the locking position, and returning the anti-theft member to the anti-theft canceling position by a reverse rotation thereof;

controller means having a locking operation for changing the locking lever into the locking position by using the motor, an anti-theft operation for changing the anti-theft member into the anti-theft position by using the motor, and an anti-theft canceling operation for changing the anti-theft member into the anti-theft canceling position by using the motor; and voltage changing circuit means for supplying power having different voltages to the motor means under control of the controller means;

wherein the controller means sets a voltage to be supplied to the motor means when performing the locking operation, as being lower than a voltage to be supplied to the motor means when performing the anti-theft operation;

wherein the controller means regulates the voltage to be supplied to the motor means when performing the locking operation so that it does not unintentionally displace the anti-theft position.

9. A door lock device having an anti-theft mechanism, comprising:

a locking lever connected to an inside lock button of a door and being displaceable between a locking position and an unlocking position;

an anti-theft member being displaceable between an anti-theft position for disabling an unlocking operation of the inside lock button and an anti-theft canceling position for enabling the unlocking operation of the inside lock button;

motor means for moving the locking lever into the locking position by a normal rotation thereof in a predetermined amount, moving the anti-theft member into the anti-theft position by a continuous normal rotation thereof over the predetermined amount for moving the locking lever into the locking position, and returning the anti-theft member to the anti-theft canceling position by a reverse rotation thereof;

controller means having a locking operation for changing the locking lever into the locking position by using the motor, an anti-theft operation for changing the anti-theft member into the anti-theft position by using the motor, and an anti-theft canceling operation for changing the anti-theft member into the anti-theft canceling position by using the motor; and voltage changing circuit means for supplying power having different voltages to the motor means under control of the controller means;

wherein the controller means has information representing an appropriate voltage range of voltages suitable for performing the operations, wherein if a voltage supplied from a battery of a vehicle is out of the appropriate voltage range, the voltage supplied to the motor means is regulated by the voltage changing circuit means so that the voltage to be supplied to the motor means when performing the locking operation is regulated so that it does not unintentionally displace the anti-theft member to the anti-theft position.

* * * * *